US006616297B1

(12) United States Patent
Chen

(10) Patent No.: US 6,616,297 B1
(45) Date of Patent: Sep. 9, 2003

(54) PUSHBUTTON AND REAR CAP MOUNTING ARRANGEMENT FOR FLASHLIGHT

(76) Inventor: Chin Hsiang Chen, 40, Lane 398, Fu Chiang Road, Sec. 2, Yung Kang, Tainan (TW)

( * ) Notice: Subject to any disclaimer, the term of this patent is extended or adjusted under 35 U.S.C. 154(b) by 0 days.

(21) Appl. No.: 10/238,128

(22) Filed: Sep. 9, 2002

(51) Int. Cl.[7] ..... F21L 4/00
(52) U.S. Cl. ..... 362/206; 362/207
(58) Field of Search ..... 362/202, 205, 362/206, 207

(56) References Cited

U.S. PATENT DOCUMENTS 5,642,932 A * 7/1997 Matthews ..... 362/206
5,722,765 A * 3/1998 Maglica ..... 362/207
6,386,732 B1 * 5/2002 Shiau ..... 362/202

* cited by examiner

*Primary Examiner*—Laura K. Tso
(74) *Attorney, Agent, or Firm*—Pro-Techtor International Services

(57) ABSTRACT

A pushbutton and rear cap mounting arrangement for flashlight is so arranged that the pushbutton is alternatively set between a first position where the pushbutton is locked in "on"position to close the circuit of the flashlight, and a second position where the pushbutton is unlocked and supported in "off" position to open the circuit and the user can push the pushbutton with the thumb to "on" position to turn on the flashlight when desired.

3 Claims, 6 Drawing Sheets

PUSHBUTTON AND REAR CAP MOUNTING ARRANGEMENT FOR FLASHLIGHT

BACKGROUND OF THE INVENTION

1. Field of the Invention

The present invention relates to a flashlight and, more specifically, to the pushbutton and rear cap mounting arrangement for flashlight.

2. Brief Description of the Related Art

FIGS. 1 and 2 show an aluminum alloy flashlight constructed according to the prior art. According to this design, the flashlight comprises a barrel 70 holding a set of battery cells on the inside and a lamp assembly on the front side, a hollow cylindrical pushbutton 10 mounted in the rear open chamber of the barrel 70, the pushbutton 10 has an outward flange 101 extended around the periphery of the front side, a conical spring 60 supported between the negative terminal of the set of battery cells inside the barrel 70 and the front side of the pushbutton 10, an electrically insulating sleeve 20 sleeved onto the pushbutton 10, the insulating sleeve 20 having an outward flange 201 extended around the periphery of the front side and supported on the outward flange 101 of the pushbutton 10, a hollow rear cap 40 threaded into the rear open side of the barrel 70, and a compression spring 30 sleeved onto the sleeve 20 and stopped between the outward flange 201 of the sleeve 20 and the front side of the rear cap 40. Further, the pushbutton 10 is a hollow structure having an inside space for holding a spare lamp bulb 50. When assembled, the rear cap 40 is fastened tight, and the pushbutton 10 partially extends out of the rear cap 40 for operation. The spring force of the conical spring 60 surpasses the spring force of the compression spring 30. Therefore, the conical spring 60 imparts a backward pressure to the pushbutton 10, keeping the pushbutton 10 away from the step 701 of the barrel 70, and therefore the circuit of the flashlight is off (see FIG. 2). When the user pressed the pushbutton 10 to conquer the spring force of the conical spring 60, the outward flange 101 of the pushbutton 10 is forced into contact with the step 701 of the barrel 70 to close the circuit, and therefore the flashlight is turned on (see FIG. 3). When the user loosened the rear cap 40 as shown in FIG. 4, the pushbutton 10 is hidden in the rear cap 40, preventing triggering of the pushbutton 10 accidentally.

This design of flashlight is still not satisfactory in function. Because the springs 30 and 60 are constantly maintained against each other, they wear quickly with use. When the springs 30 and 60 start to wear, the electric contact becomes unstable, and the lamp bulb may flash abnormally. When keeping the lamp bulb electrically connected, the user must keep the pushbutton 10 depressed.

Therefore, it is desirable to provide a flashlight that eliminates the aforesaid drawbacks.

SUMMARY OF THE INVENTION

The present invention has been accomplished to provide a pushbutton and rear cap mounting arrangement for flashlight, which eliminates the aforesaid drawbacks. It is the main object of the present invention to provide a pushbutton and rear cap mounting arrangement for flashlight, which keeps the lamp bulb of the flashlight constantly electrically connected when the rear cap fastened tight. It is another object of the present invention to provide a pushbutton and rear cap mounting arrangement for flashlight, which enables the pushbutton to be moved between two positions to turn on/off the flashlight when the rear cap loosened. It is still another object of the present invention to provide a pushbutton and rear cap mounting arrangement for flashlight, which is durable in use. According to the present invention, the pushbutton and rear cap mounting arrangement is comprised of an electrically conducting barrel holding a series of battery cells and a lamp holder on the front side of the battery cells, the barrel having a rear open chamber and a stepped inside wall in the rear open chamber, an electrically conducting pushbutton supported on an electrically conducting conical spring at the negative terminal of the battery cells, the pushbutton having an annular contact flange extended around the periphery of the front side thereof and adapted to contact the stepped inside wall of the barrel in the rear open chamber, an electrically insulating sleeve sleeved onto the pushbutton, the sleeve having an annular flange extended around the periphery of the front side thereof and supported on the annular contact flange of the pushbutton, and an electrically conducting hollow rear cap threaded into the rear open chamber of the barrel around the sleeve and rotated forwards/backwards between a first position where the pushbutton is locked in "on" position to close the circuit of the flashlight, and a second position where the pushbutton is unlocked and supported in "off" position to open the circuit of the flashlight and the user can push the pushbutton with the thumb to "on" position to turn on the flashlight when desired.

BRIEF DESCRIPTION OF THE DRAWINGS

FIG. 3 is similar to FIG. 2 but showing the pushbutton pressed, the flashlight turned on.

FIG. 7 is a sectional view of the present invention showing the rear cap fastened tight, the flashlight turned on.

FIG. 9 is a schematic sectional view of the present invention showing the rear cap loosened, the pushbutton pressed, the flashlight turned on.

DETAILED DESCRIPTION OF THE PREFERRED EMBODIMENT

Figure 1:
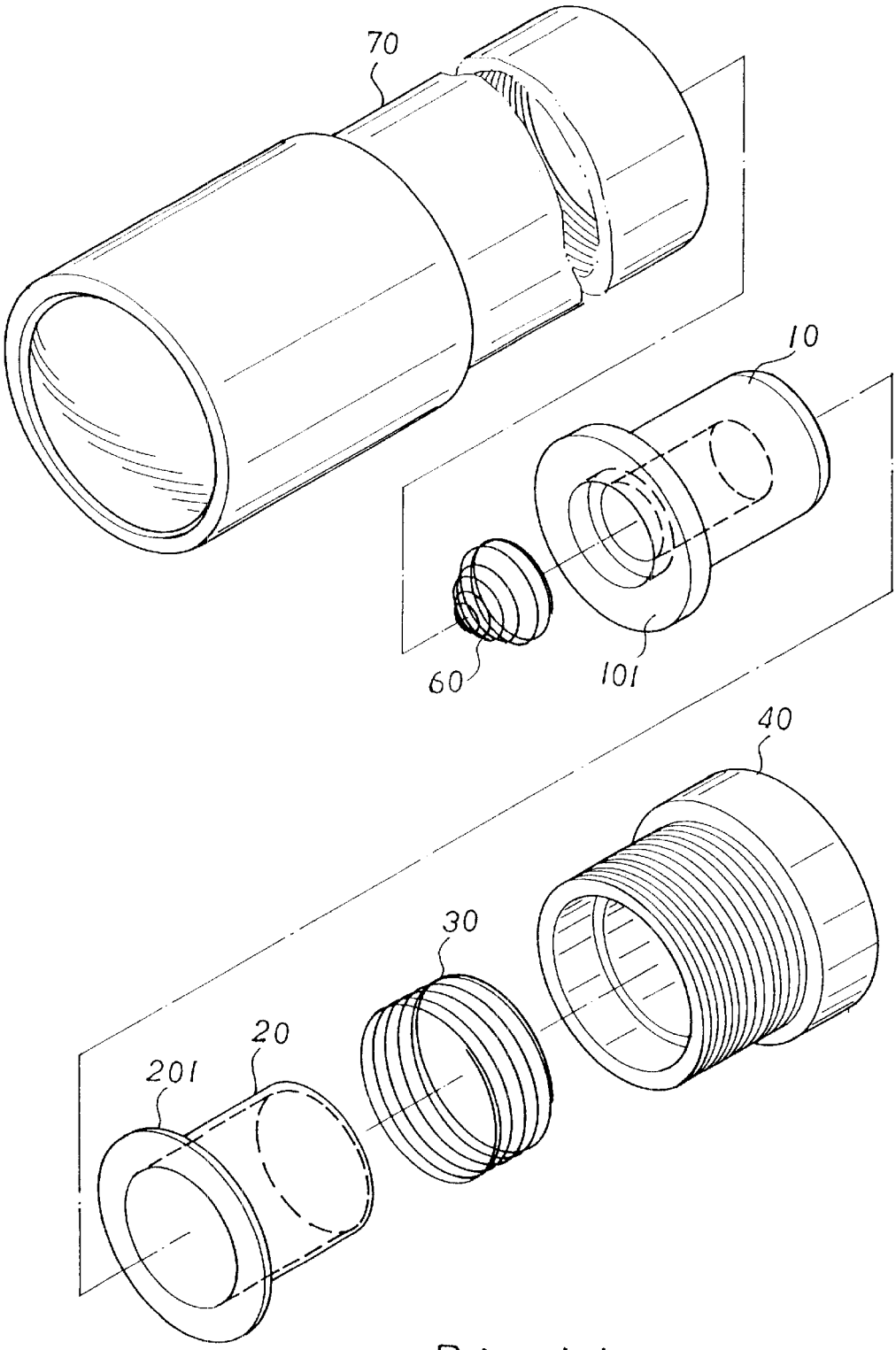
Prior Art FIG. 1
FIG. 1 is an exploded view of a flashlight according to the prior art design.
Figure 2:
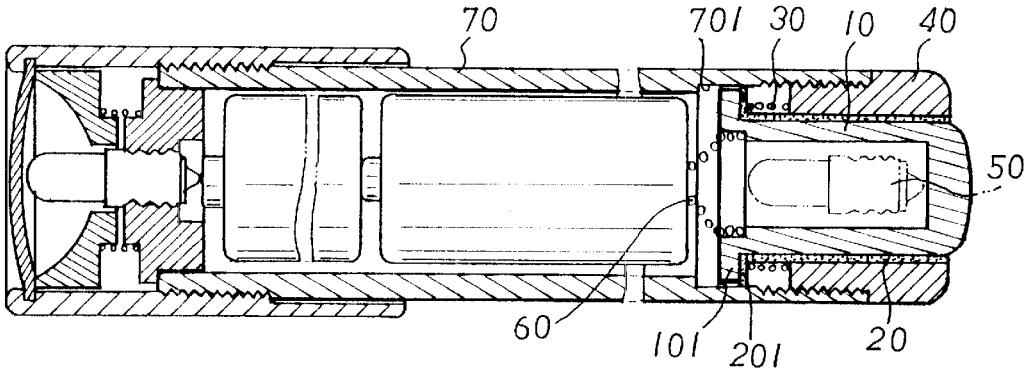
Prior Art FIG. 2
FIG. 2 is a sectional assembly view of the prior art design.
Figure 3:
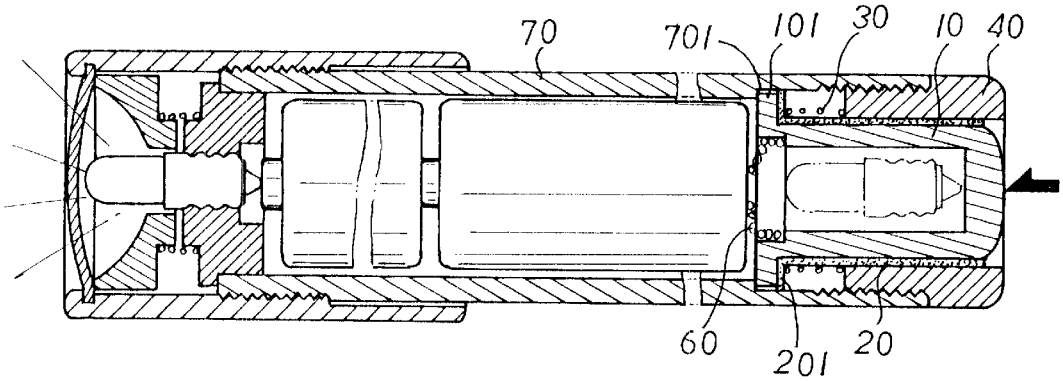
Prior Art FIG. 3
Figure 4:
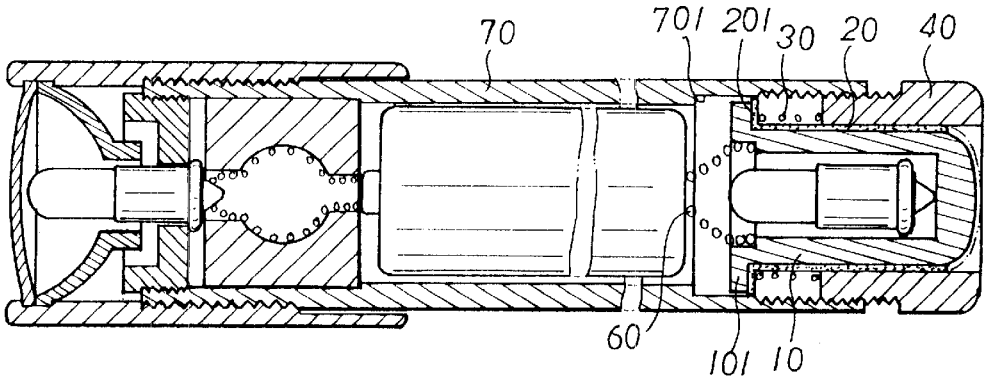
Prior Art FIG. 4
FIG. 4 is similar to FIG. 2 but showing the rear cap loosened, the flashlight turned off.
Figure 5:
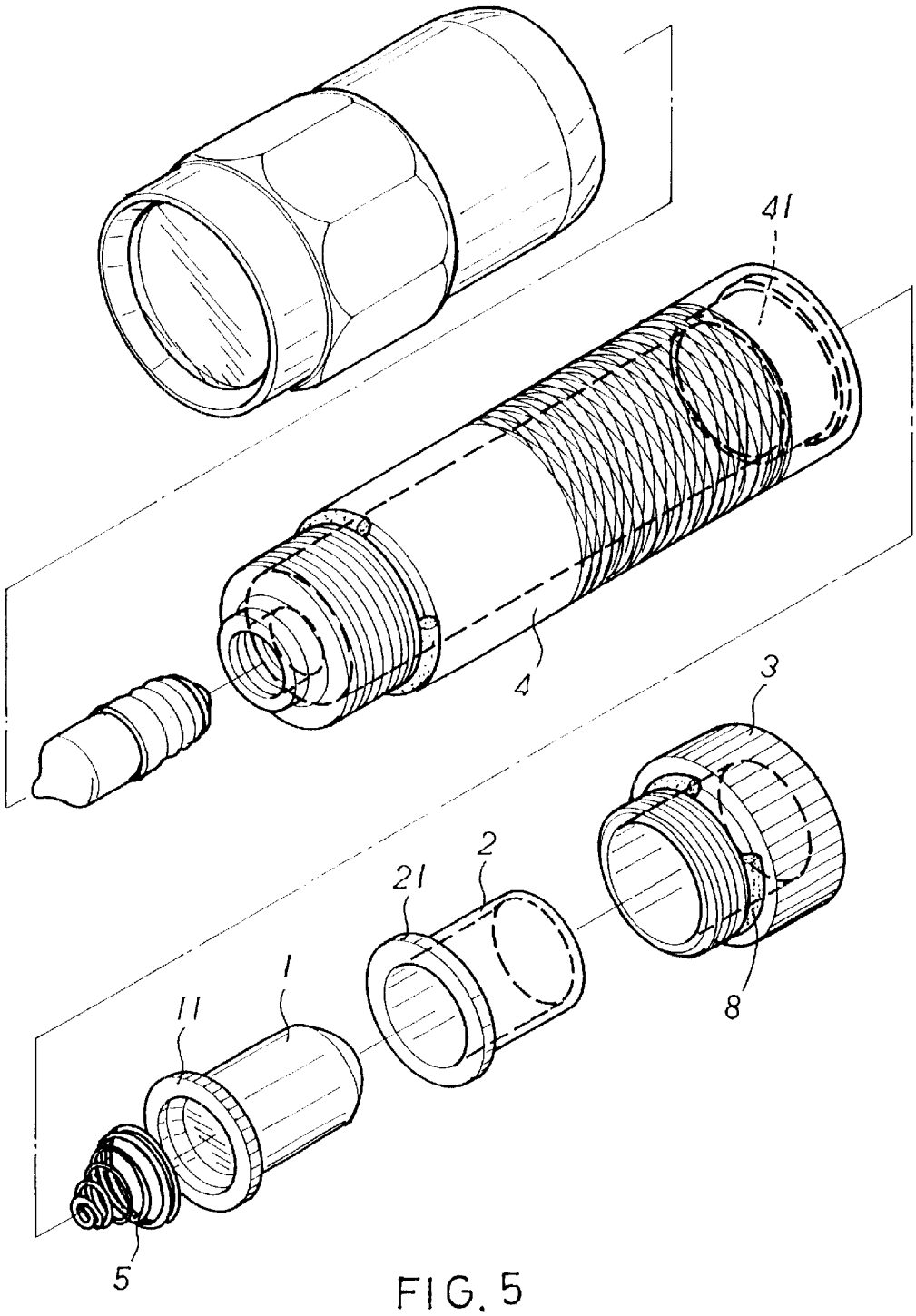
FIG. 5 is an exploded view of a pushbutton and rear cap mounting arrangement for flashlight according to the present invention.
Figure 6A:
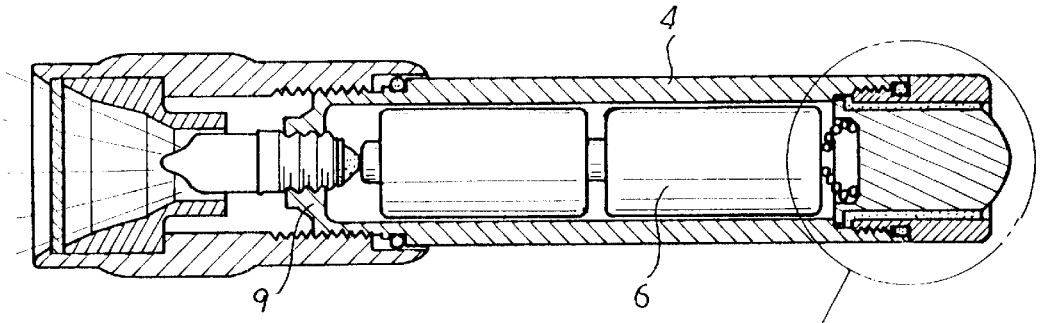
FIG. 6A is a sectional assembly view of the present invention.
Figure 6B:
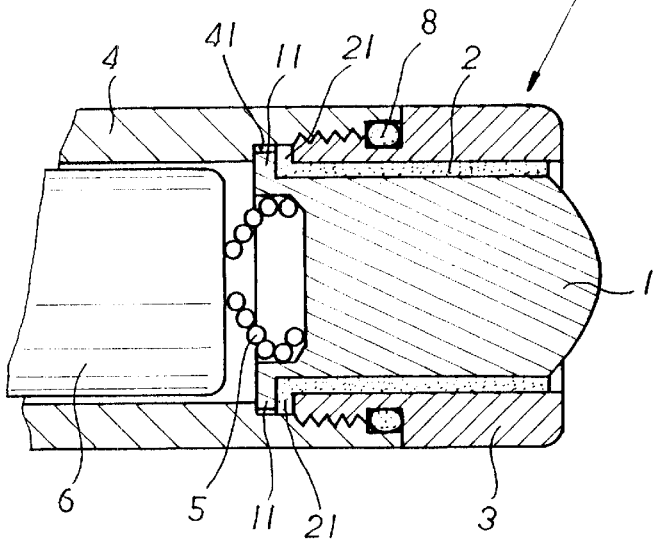
FIG. 6B is an enlarged view of a part of FIG. 6A.

Referring to FIGS. 5, 6A, and 6B, a pushbutton and flashlight mounting arrangement in accordance with the present invention is shown comprised of an electrically conducting pushbutton 1, an electrically insulating sleeve 2, an electrically conducting rear cap 3, an electrically conducting barrel 4 holding a set of battery cells 6, and an electrically conducting conical spring 5. The barrel 4 has a rear open chamber 41, which receives the push button 1.

The pushbutton 1 has an annular contact flange 11 extended around the periphery of the recessed front side thereof and adapted to contact a stepped inside wall of the electrically conducting barrel 4 in the rear open chamber 41. The electrically conducting conical spring 5 is supported between the negative terminal of the set of battery cells 6 and the recessed front side of the pushbutton 1. Alternatively, the pushbutton 1 can be made having a hollow structure for receiving a spare lamp bulb 7 on the inside (see FIG. 7).

The electrically insulating sleeve 2 is sleeved onto the pushbutton 1, having an annular outward flange 21 extended around the periphery of the front open side thereof and supported on the contact flange 11 of the pushbutton 1. The outer diameter of the annular outward flange 21 is slightly greater than the outer diameter of the annular contact flange 11 of the pushbutton 1.

The rear cap 3 is a hollow screw cap threaded into the rear open chamber 41 of the barrel 4 around the electrically insulating sleeve 2. When the rear cap 3 fastened tight (rotated forwards to the limit), the contact flange 11 of the pushbutton 1 is forced into close contact with the stepped inside wall of the barrel 4 in the rear open chamber 41 to close the circuit of the flashlight (see FIG. 6). On the contrary, when the rear cap 3 loosened (rotated backwards), the conical spring 5 pushes the pushbutton 1 backwardly away from the stepped inside wall of the barrel 4 in the rear open chamber 41. At this time, the annular outward flange 21 of the electrically insulating sleeve 2 prohibits direct contact between the contact flange 11 of the pushbutton 1 and the inside wall of the barrel 4, i.e., the negative terminal of the set of battery cells 6 is disconnected from the barrel 4, and the circuit of the flashlight is opened to turn off the light (see FIG. 8).

Figure 7:
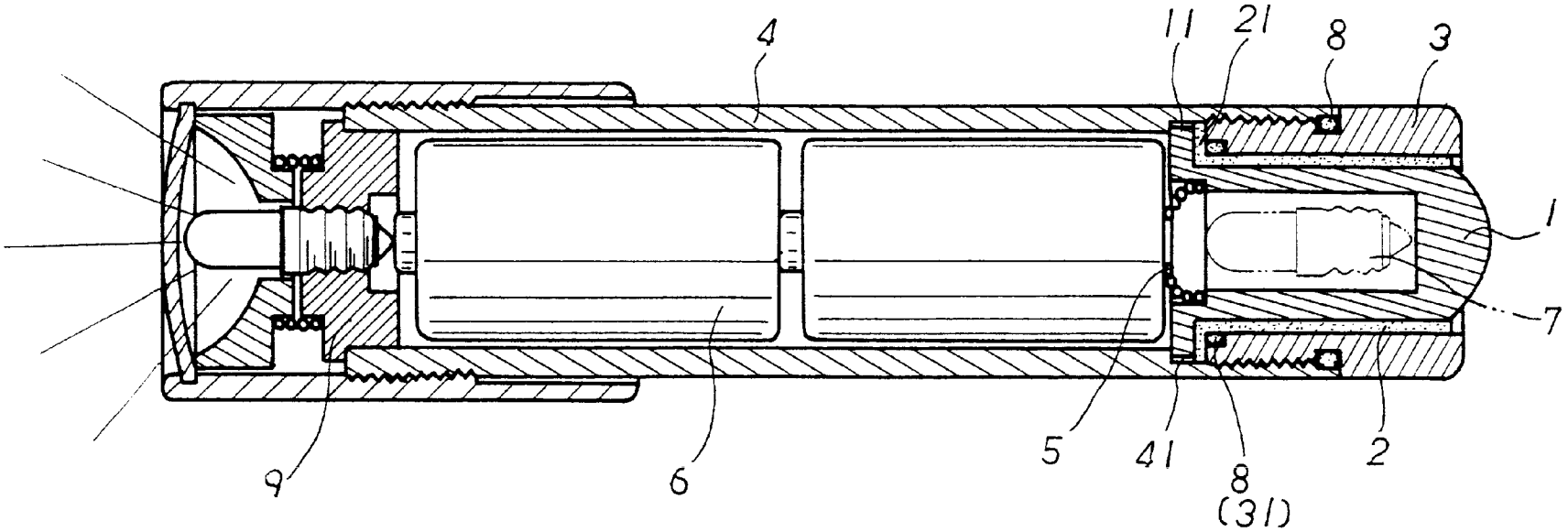

The rear cap 3 has an annular groove 31 extended around the periphery and mounted with a water seal ring 8 (see FIG. 7). When the rear cap 3 fastened to the rear open chamber 41 of the barrel 4, the water seal ring 8 seals the gap between the barrel 4 and the rear cap 3 against water.

An electrically conducting lamp holder 9 is located on the front side of the barrel 4 to hold a lamp bulb (keeping the ring contact of the lamp bulb is contact with the lamp holder 9 and the tip contact of the lamp bulb in contact with the positive terminal of the set of battery cells 5). The lamp holder 9 can be formed integral with the front side of the barrel 4 as shown in FIGS. 5, 6, 8, and 9). Alternatively, the lamp holder 8 can be a separated member detachably fastened to the barrel 4 (see FIG. 7).

Figure 8:
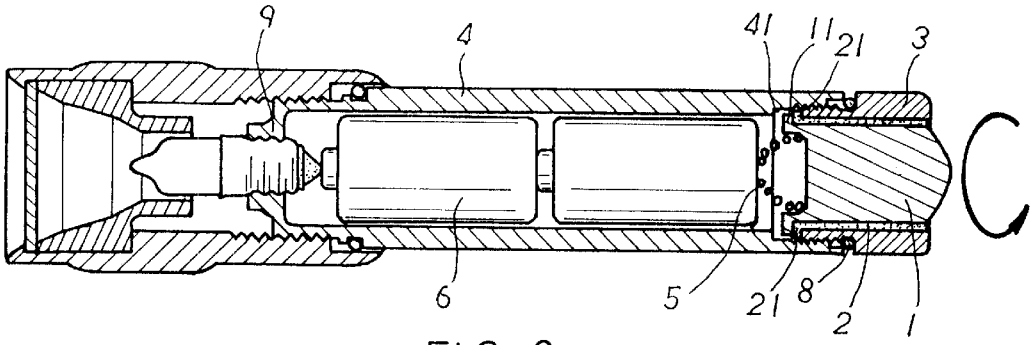
FIG. 8 is a schematic sectional view of the present invention showing the rear cap loosened, the flashlight turned off.
Figure 9:
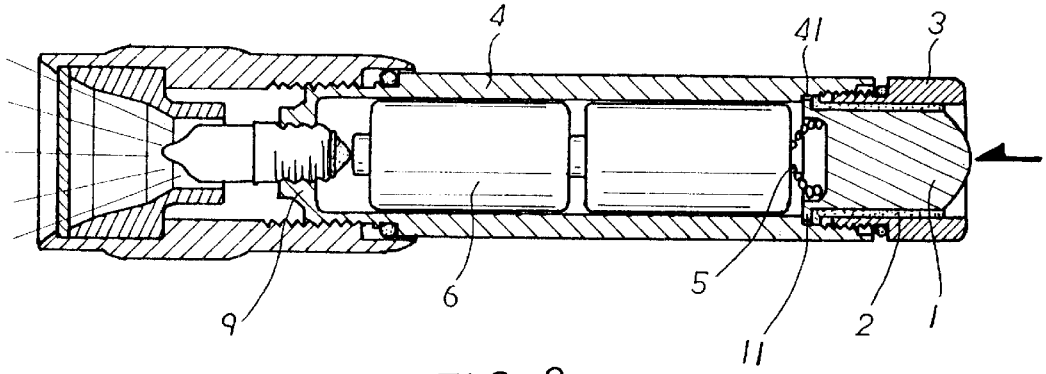

As indicated above, the user can fasten tight the rear cap 3 to hold the pushbutton 1 in the front position, i.e., "on" position as shown in FIG. 6, or loosen the rear cap 3 to let the pushbutton 1 be pushed backwards by the conical spring 5 to the rear position, i.e., "off" position as shown in FIG. 8. When the pushbutton 1 moved to "off" position, the user can still push the pushbutton 1 forwards into contact with the stepped inside wall of the barrel 4 in the rear open chamber 41 to close the circuit and to turn on the flashlight with the thumb.

A prototype of push button and rear cap mounting arrangement for flashlight has been constructed with the features of FIGS. 5~9. The push button and rear cap mounting arrangement functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A push button and rear cap mounting arrangement comprising an electrically conducting barrel holding a series of battery cells and a lamp holder on a front side of said battery cells, said electrically conducting barrel having a rear open chamber and a stepped inside wall extended around said rear open chamber, an electrically conducting pushbutton supported on an electrically conducting spring at one terminal of said battery cells, said pushbutton having an annular contact flange extended around the periphery of a front side thereof and adapted to contact the stepped inside wall of said electrically conducting barrel, an electrically insulating sleeve sleeved onto said pushbutton, said electrically insulating sleeve having an annular outward flange extended around the periphery of a front open side thereof and supported on the annular contact flange of said pushbutton, the annular outward flange of aid electrically insulating sleeve being greater than the annular contact flange of said pushbutton, and a hollow rear cap threaded into the rear open chamber of said electrically conducting barrel around said electrically insulating sleeve and rotated forwards/backwards in the rear open chamber of said electrically conducting barrel between a first position where the annular contact flange of said pushbutton is maintained in contact with the stepped inside wall of said electrically conducting barrel to close the circuit of said battery cells and said lamp holder and a second position where said pushbutton is disconnected from the stepped inside wall of said electrically conducting barrel to open the circuit of said battery cells and said lamp holder for enabling said pushbutton to be pushed by the user into contact with the stepped inside wall of said electrically conducting barrel to close the circuit of said battery cells and said lamp holder when desired.

2. The push button and rear cap mounting arrangement as claimed in claim 1, wherein said pushbutton is a hollow member having an inside space adapted to hold a spare lamp bulb.

3. The push button and rear cap mounting arrangement as claimed in claim 1, wherein said rear cap has an annular groove extended around the periphery thereof, and a water seal ring mounted in said annular groove and stopped against an inside wall of said electrically conducting barrel in said rear open chamber.

* * * * *